United States Patent [19]

Hasler et al.

[11] Patent Number: 4,489,650

[45] Date of Patent: Dec. 25, 1984

[54] TYPE BELT PRINTER WITH ANTIFRICTION MEANS

[75] Inventors: Werner Hasler, Schoenaich; Subramaniam Padmanabhan, Herrenberg; Klaus Staudenmaier, Gechingen, all of Fed. Rep. of Germany

[73] Assignee: International Business Machines Corporation, Armonk, N.Y.

[21] Appl. No.: 127,614

[22] Filed: Mar. 6, 1980

Related U.S. Application Data

[63] Continuation of Ser. No. 885,058, Mar. 9, 1978, abandoned.

[30] Foreign Application Priority Data

Mar. 24, 1977 [DE] Fed. Rep. of Germany ..... 2712998

[51] Int. Cl.[3] ..... B41J 1/20

[52] U.S. Cl. ..... 101/93.14; 101/111; 400/146

[58] Field of Search ..... 101/111, 417, 93.13, 101/93.14; 400/701, 702, 146, 247, 656, 657

[56] References Cited

U.S. PATENT DOCUMENTS

| | | | |
|---|---|---|---|
| 127,815 | 6/1872 | Warren | 101/417 |
| 752,876 | 2/1904 | Wood | 101/417 |
| 849,454 | 4/1907 | Beeken | 101/417 |
| 857,753 | 6/1907 | Pierce | 101/417 |
| 1,873,207 | 8/1932 | Knowlton | 101/417 |
| 2,699,244 | 1/1955 | Markes | 400/247 |
| 2,743,206 | 4/1956 | Verduin | 101/417 |
| 3,610,140 | 10/1971 | Kondur | 400/247 |
| 3,638,565 | 2/1972 | Drejza et al. | 101/93.14 |
| 3,845,711 | 11/1974 | Helms | 101/111 |
| 3,981,236 | 9/1976 | Johnston | 101/93.14 |
| 3,987,723 | 10/1976 | Mahoney | 101/93.14 |
| 4,006,680 | 2/1977 | Grace | 101/93.14 |
| 4,177,727 | 12/1979 | Cooke | 101/93.14 |
| 4,211,166 | 7/1980 | Hardt | 101/111 |

FOREIGN PATENT DOCUMENTS

| | | | |
|---|---|---|---|
| 235545 | 10/1925 | United Kingdom | 101/417 |
| 360562 | 11/1931 | United Kingdom | 101/111 |

OTHER PUBLICATIONS

Dayger, IBM Tech. Disc. Bulletin, vol. 10, No. 3, Aug. 1967, p. 299.

Drejza, IBM Tech. Disc. Bulletin, vol. 4, No. 11, Apr. 1962, p. 16.

*Primary Examiner*—Clyde I. Coughenour

*Attorney, Agent, or Firm*—John S. Gasper

[57] ABSTRACT

To reduce the extremely high wear in steel belt printers, a revolving tape is arranged between the revolving steel belt and the platen.

10 Claims, 1 Drawing Figure

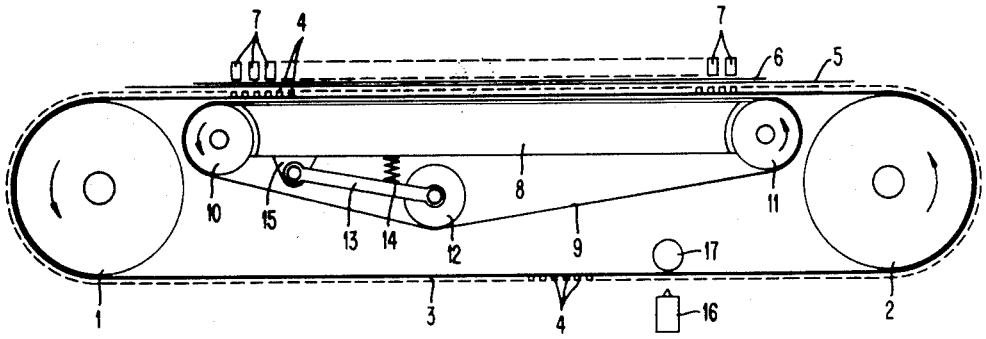
7
4
7
6
5
10
15
13
14
12
8
9
11
17
16
1
3
4
2

TYPE BELT PRINTER WITH ANTIFRICTION MEANS

This is a continuation of application Ser. No. 885,058 filed Mar. 9, 1978, now abandoned.

BACKGROUND OF THE INVENTION

1. Field of the Invention

The invention relates to a printer with a revolving type belt.

2. Description of Prior Art

The German Offenlegungsschrift No. 2 344 923 describes a type printer with a revolving, endless type carrier guided on two rolls spaced from each other. This type carrier has a straight section in which the types are printed and which extends parallelly to the printing line. In addition, the type carrier is provided with emitter marks which are sensed by a stationary sensor. The type belt is contact friction driven and is made of relatively thin non-ferrous steel. Along is edge the belt is provided with a plurality of spaced fingers, each supporting a raised type or character.

The German Offenlegungsschrift No. 2 224 951 refers to a printer with a type carrier moving along the printing line on the side of the document to be printed and being provided with types arranged on spaced fingers, as well as with selectable print hammers. The type carrier preferably consists of a flexible, endless metal belt.

Also known are steel type printers in which the characters, rather than being disposed on finger-shaped segments, are located on the steel belt direct.

All of these arrangements are unsuitable for high belt and thus high printing speeds, because of the high drive speeds and the resulting high degree of wear and deformation in the type sections (provided that the types, rather than being disposed on the steel belt, are electrochemically etched on same). The high type belt wear occurs especially on the platen which is a steel plate in most cases and on which the belt slides. If one tolerates a disproportionately high wear of the type carrier at high printing speeds, one will equally have to tolerate the fact that the type carrier has to be exchanged at short intervals. This, however, is disadvantageous for cost reasons.

SUMMARY OF THE INVENTION

Therefore, it is the object of the invention to provide a type belt printer in which the degree of wear encountered is very low even at high printing speeds.

Broadly, the invention achieves the above as well as other objects and advantages by providing a movable tape located between the type belt and the platen which prevents direct contact of the type belt with the platen. The tape which is made of wear-resistant material such as plastic or metal moves in the same direction as but at a lower speed than the type belt. The tape mounted on pulleys may be driven by means connected to the tape pulleys or in other suitable manner. Alternatively, the tape may be moved as a result of frictional contact with the driven type belt, the contact occurring as a result of the print hammers impacting the type belt. A lubricant in the form of a magnetic fluid retained in position by magnets is provided between the platen and the tape to further reduce wear in the system.

The foregoing and other objects, features and advantages of the invention will be apparent from the following more particular description of preferred embodiments of the invention, as illustrated in the accompanying drawing.

BRIEF DESCRIPTION OF THE DRAWING

The single FIGURE is a diagrammatic representation in the form of a plan view of a belt printer.

DETAILED DESCRIPTION

The endless type belt 3 consists of a relatively thin belt of a non-ferrous steel. This belt carries characters 4 which are raised in the direction of print. These characters may be electrochemically etched on the belt material or be arranged on same in some other manner. The type belt is led over two spaced pulleys, the drive pulley 1 and the tension pulley 2. The belt is driven by contact friction via drive pulley 1. With this type of belt guide there is a relatively long straight section in which printing takes place and in which the belt faces the printing line. During printing a selected hammer 7 is fired in the direction of type belt 3 at a time at which a desired character on the type belt moves past said hammer. Between type belt character 4 and hammer 7 a narrow or a wide ribbon 5 and the paper 6 are arranged on which the character is printed. As hammer 7 is fired against the selected type belt character 4, the hammer movement is limited by a stationary platen 8 arranged behind type belt 3 and which generally is a stationary rigid steel plate. An endless tape 9 of metal or plastic moves between type belt 3 and platen 8. Said tape 9 is led via pulleys 10 and 11 which are fixed to the ends of platen 8. A further pulley 12 serves as a tension pulley for said tape 9. Via a single sided lever 13 with fulcrum 15, this pulley 12 is fixed to the side of platen 8 averted from the printing process. Lever 13 is forced by the platen via a compression spring 4 in the direction of the tensioned tape 9. Pulley 10 can also be flexibly supported, acting as a tension pulley in such a case. The revolving tape 9 moves in the same direction as the type belt, but at a lower speed. In the preferred embodiment, tape 9 is driven with either of the pulleys 10 or 11 serving as the drive pulley. Alternatively, tape 9 can be driven solely by the frictional contact with type belt 3 resulting from the impact of hammers 7. With such an arrangement the enormous wear and deformation encountered in the region of the types or characters of steel belt printers is reduced to a neglible rate. A theoretical explanation of this phenomenon is currently not available. It is assumed, however, that deviating from physical knowledge, the coefficient of friction is a function of the speed. This interdependence between speed and coefficient of friction could be explained in terms of the phenomenon that it is encountered only with hammer drives. The material of type 12 is preferably a wear-resistant plastic or a suitable metal.

To reduce further the wear of the tape with regard. to platen 8, magnetic fluid lubrication could be provided in this region. This type of lubrication which is known from the art does not form part of the subjectmatter of the invention. In the case of magnetic fluid lubrication, a magnetic fluid would be provided between tape 9 and platen 8 on the side facing the printing process, said fluid being held in place by permanent magnets in the platen.

For synchronizing the type belt, emitter 16 is provided, by means of which a pulse is triggered in a photoelement 17 if at a particular time an aperture in the type belt moves as a synchronization mark past the emitter.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An on-the-fly impact printer having the combination of a continuous flat flexible type belt having a straight section running parallel with a print line, said type belt carrying characters fixed on a front side thereof facing said print line, drive means for revolving said type belt whereby said characters are in continuous motion along said print line during printing, hammer means located at print positions along said straight section opposite said front side of said type belt, said hammer means being operable to impact an interpositioned recording medium during said motion against said characters on the front side of said straight section of said revolving type belt, platen means for limiting displacement of said flexible type belt resulting from said impact of said print medium by said hammer means, said platen means having a stationary impact surface positioned behind said straight section of and proximate the back surface of said type belt, the improvement comprising means for reducing wear of said type belt caused by frictional contact comprising, a separate flexible bearing tape of wear-resistant material interposed between said impact surface and said straight section of said type belt for preventing direct frictional contact between said moving type belt and said stationary impact surface, said bearing tape having oppositely facing bearing surfaces slidably engageable during impact with said impact surface and said straight section of said type belt, said bearing tape being movable relative to and in the direction of motion of said revolving type belt during impact.

2. An on-the-fly impact printer in accordance with claim 1 in which said flexible type belt is a thin metal band having said fixed characters etched on said front side thereof.

3. An on-the-fly impact printer in accordance with claim 1 in which said bearing tape is a continuous revolving bearing tape.

4. An on-the-fly impact printer in accordance with claim 3 in which said bearing tape is made of plastic.

5. An on-the-fly impact printer in accordance with claim 3 in which said bearing tape is made of metal.

6. An on-the-fly impact printer in accordance with claim 5 in which a lubricant which is a magnetic fluid is provided between said impact surface and said bearing tape, and magnet means are provided for retaining said magnetic fluid lubricant between said impact surface and said bearing tape.

7. An on-the-fly impact printer in accordance with claim 3 in which said bearing tape is movable at a lower speed than said type belt.

8. An on-the-fly impact printer in accordance with claim 7 in which said bearing tape is moved by a drive means.

9. An on-the-fly impact printer in accordance with claim 7 in which said bearing tape is moved solely by frictional contact of one of said bearing surfaces with said back surface said revolving type belt.

10. An on-the-fly impact printer in accordance with claim 9 in which said frictional contact is produced by said hammer means impacting said interpositioned recording medium against said type belt.

* * * * *